US005735161A

United States Patent [19]

Brown et al.

[11] Patent Number: 5,735,161

[45] Date of Patent: Apr. 7, 1998

[54] FLANGING APPARATUS

[75] Inventors: Gerald A. Brown, Roseville; Gerrit W. Sloat, Grand Blanc; Timothy A. VerVaecke, New Baltimore, all of Mich.

[73] Assignee: Western Atlas, Inc., Warren, Mich.

[21] Appl. No.: 789,753

[22] Filed: Jan. 28, 1997

[51] Int. Cl.[6] ..... B21D 11/10; B21D 11/22

[52] U.S. Cl. ..... 72/306; 72/313; 72/404; 72/447

[58] Field of Search ..... 72/306, 307, 312–315, 72/404, 447, 448

[56] References Cited

U.S. PATENT DOCUMENTS

| | | | |
|---|---|---|---|
| 1,780,432 | 11/1930 | McGregor | 72/313 |
| 3,677,059 | 7/1972 | Miller | 72/323 |
| 3,967,487 | 7/1976 | Stout | 72/404 |
| 5,343,727 | 9/1994 | Osaka | 72/306 |
| 5,474,437 | 12/1995 | Kuroyone | 72/313 |

FOREIGN PATENT DOCUMENTS

| | | | |
|---|---|---|---|
| 300137 | 1/1989 | European Pat. Off. | 72/306 |
| 192713 | 8/1993 | Japan | 72/315 |

*Primary Examiner*—Daniel C. Crane
*Attorney, Agent, or Firm*—Barnes, Kisselle, Raisch, Choate, Whittemore & Hulbert, P.C.

[57] ABSTRACT

Apparatus for forming a panel to a predetermined cross dimension by flangers which form flanges on the opposite side edges of the panel. The flangers are movable toward and away from advanced positions in which to form the flanges. The advanced positions can be adjusted depending on the cross dimension desired. The flangers can be retracted to permit loading and unloading of panels. Forming units are also provided to form tabs on an end of the panel.

11 Claims, 11 Drawing Sheets

FLANGING APPARATUS

FIELD OF INVENTION

This invention relates generally to apparatus for forming panels and more particularly to apparatus for forming a panel to a desired cross dimension.

BACKGROUND OF THE INVENTION

In the past, the forming of automotive panels, including floor panels, to a predetermined cross dimension, has been carried out in a conventional press. The cross dimension is established by forming flanges on both sides of the panel. When the panel specifications call for separate sets of flanges, for example, some bent upwardly and others downwardly, this has required two or more operations, as well as separate dies or separate presses. Also, when it was desired to make panel to a different cross dimension, it was necessary either to change dies or run the panel through a different press. The time and equipment required to make these panels has added greatly to the cost of production.

In addition, loading and unloading of panels has been difficult because the only available path was through the front or rear of the press.

What is needed is apparatus which can form a panel to the desired cross dimension in a single operation, is capable of being adjusted to accommodate differing cross dimension requirements, and in which the panels can be loaded and unloaded quickly and easily.

SUMMARY OF THE INVENTION

In accordance with the present invention, separate forming units on the opposite side edges of the panel are provided to form the panel edges and establish the cross dimension. The forming units are preferably operated by ball screw drives and are mounted on tracks so that they can be moved toward and away from the panel. Additional forming units may be employed, if necessary or desired. When it becomes necessary to form the panels to a different cross car dimension, this can be accomplished quickly and easily by adjusting the positions of the forming units. Also, because the forming units can be retracted, it is possible to load and unload panels more conveniently from a position above the work station, if desired. The forming units may form the panel edges, for example, by flanging, piercing or trimming.

Further in accordance with the invention, bending units are provided to form tabs along one end of the panel, the tabs serving, for example, as locators for the panels when they are installed in a vehicle.

One object of the invention is to provide forming apparatus for panels having the foregoing features and capabilities.

Another object is to provide forming apparatus which is composed of a relatively few simple parts, is rugged and durable in use, and is capable of being readily manufactured, installed and operated.

These and other objects, features and advantages of the invention will become more apparent as the following description proceeds, especially when taken with the accompanying claims and drawings.

DETAILED DESCRIPTION

Figure 1:
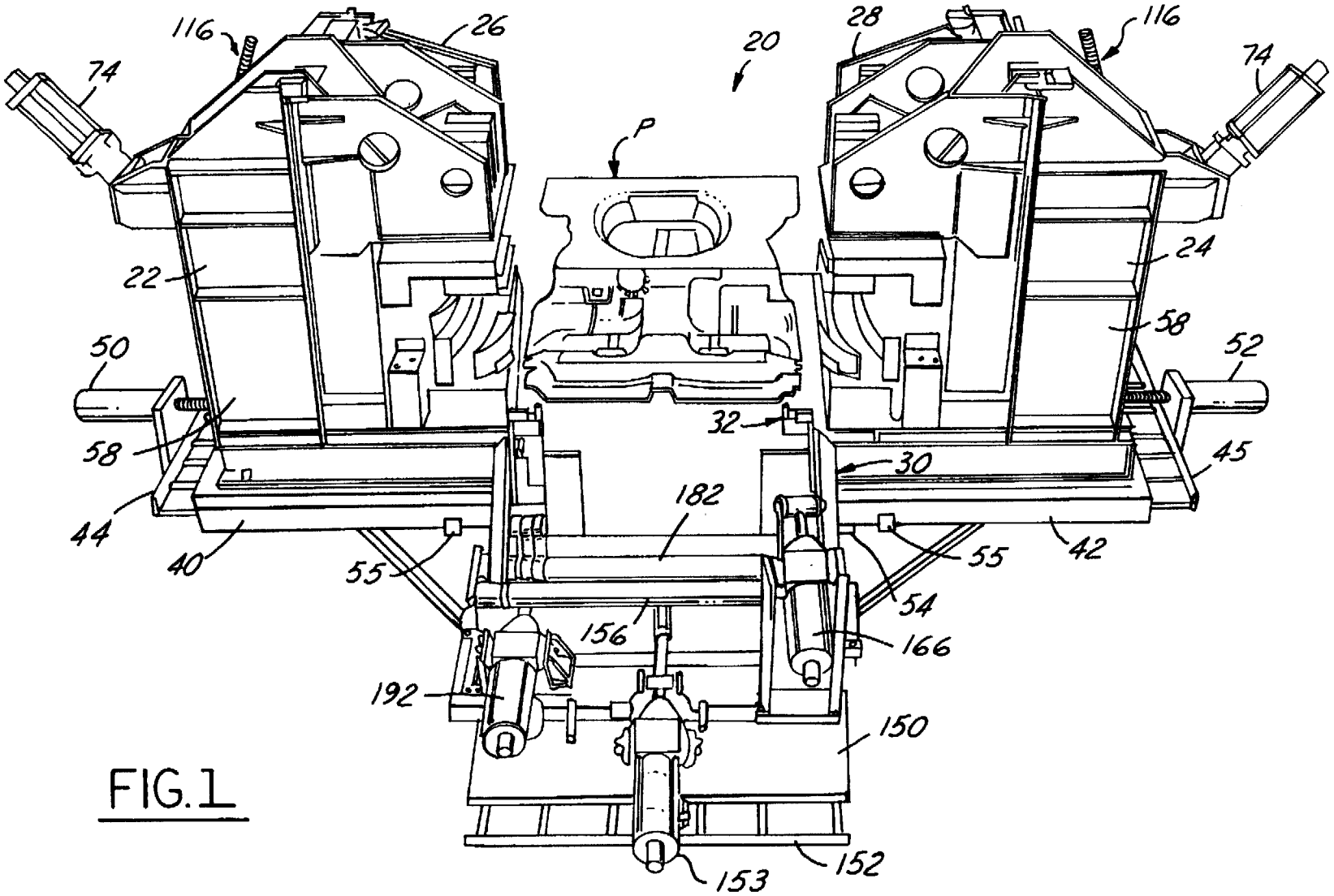
FIG. 1 is a front perspective view of apparatus constructed in accordance with the invention, showing the forming units in their open or retracted positions.

Referring now more particularly to the drawings, and especially FIGS. 1 to 4, the apparatus 20 comprises four forming units 22, 24, 26 and 28. Since the forming units operate to form flanges, they are sometimes hereinafter referred to as "flangers". The apparatus also includes two bending units, hereinafter referred to as "tabbers", identified by the numbers 30 and 32. The two front flangers 22 and 24 are disposed on opposite sides of a work station 34 where a panel P to be processed is supported in horizontal position on a support 36. The panel in this instance is the floor pan of an automotive vehicle. The two rear flangers 26 and 28 are disposed on opposite sides of the work station, to the rear of the respective flangers 22 and 24.

The flangers 22 and 26 on one side of the work station are supported side-by-side on a table 40. The flangers 24 and 28 on the opposite side of the work station are supported side-by-side on a table 42. The tables 40 and 42 are mounted for movement toward and away from the work station on parallel tracks or guides 44 and 45.

Figure 2:
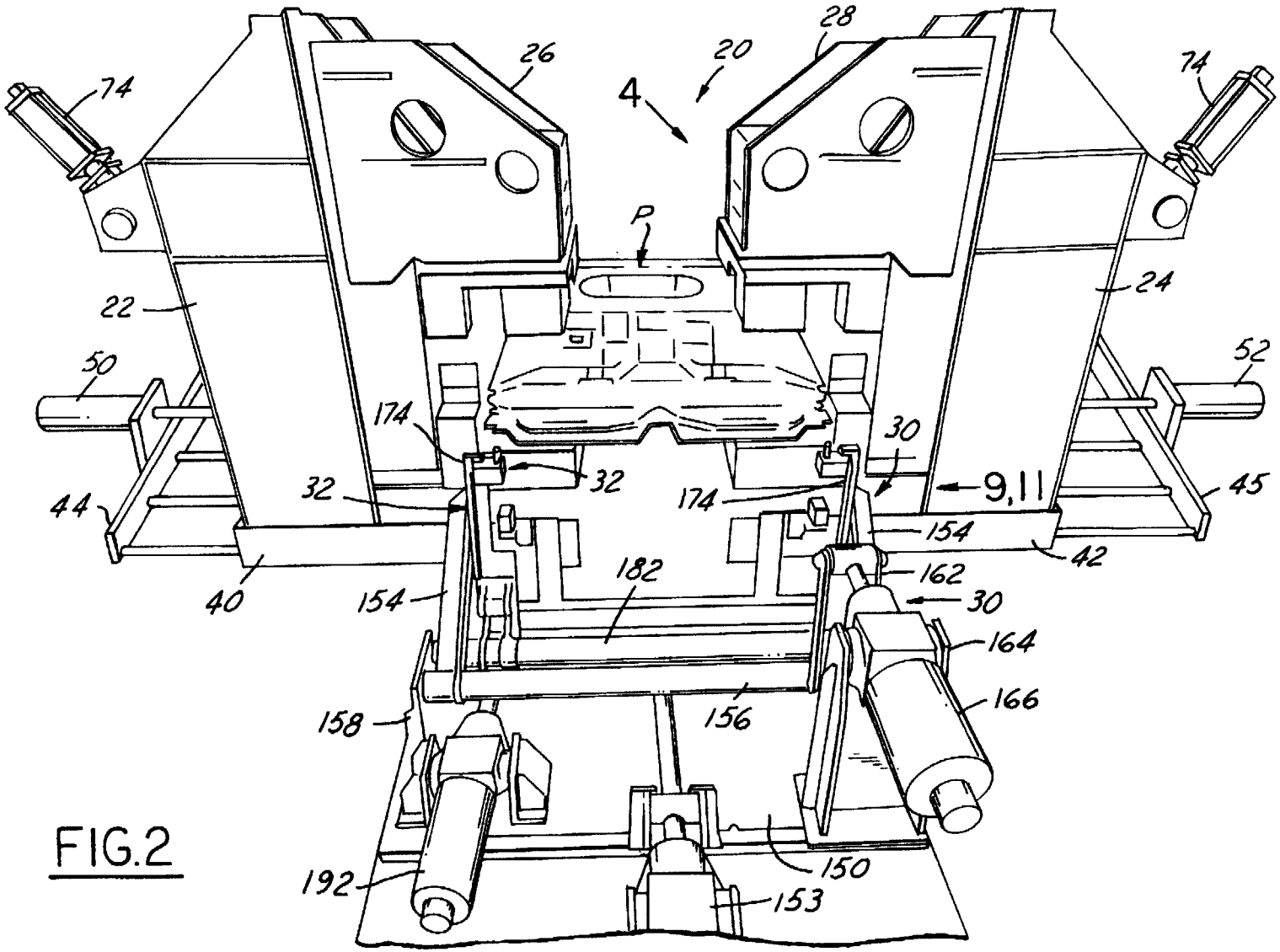
FIG. 2 is a perspective view of the apparatus shown in FIG. 1, showing the forming units in their closed or advanced positions.
Figure 3:
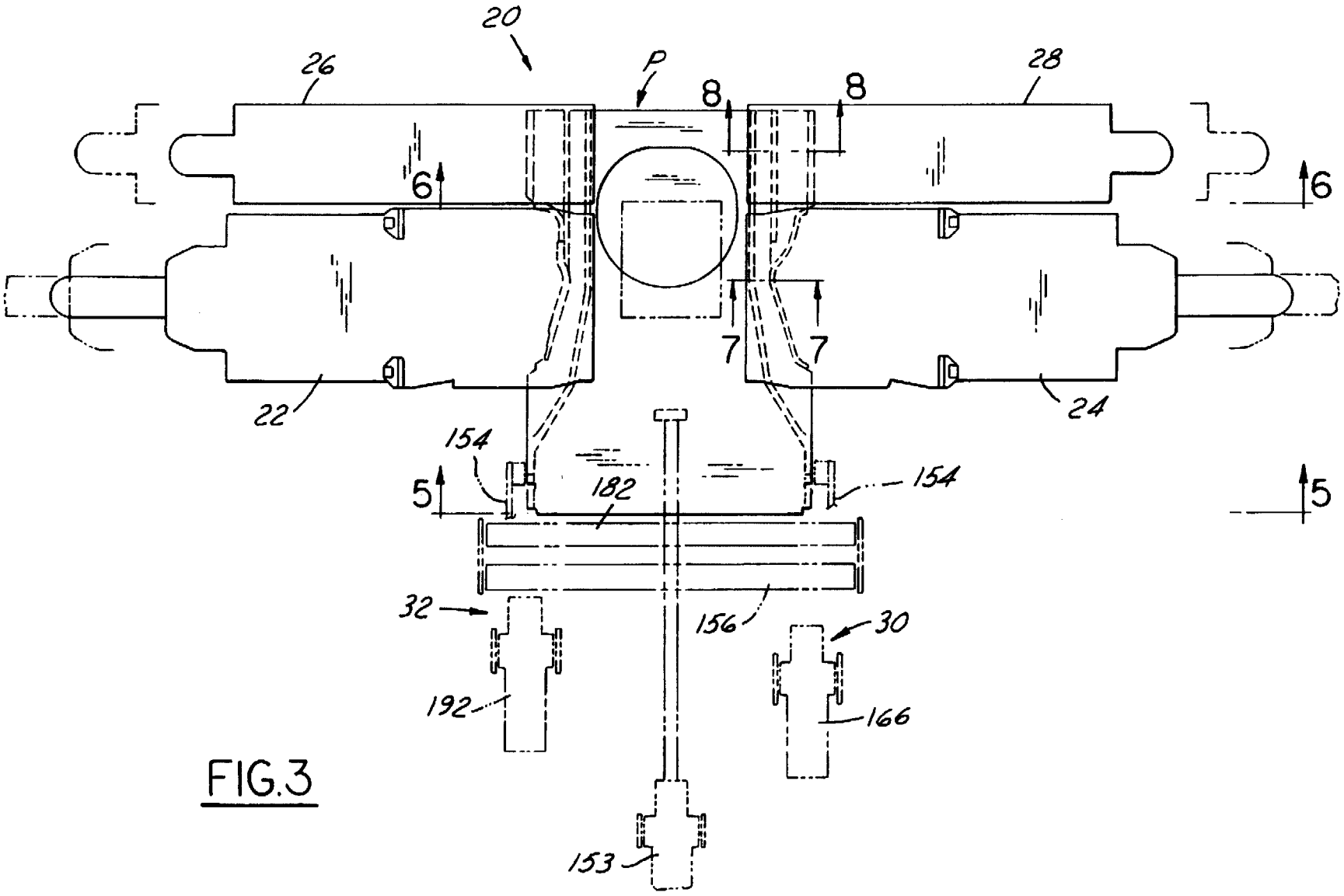
FIG. 3 is a schematic view of the apparatus as seen from above.
Figure 4:
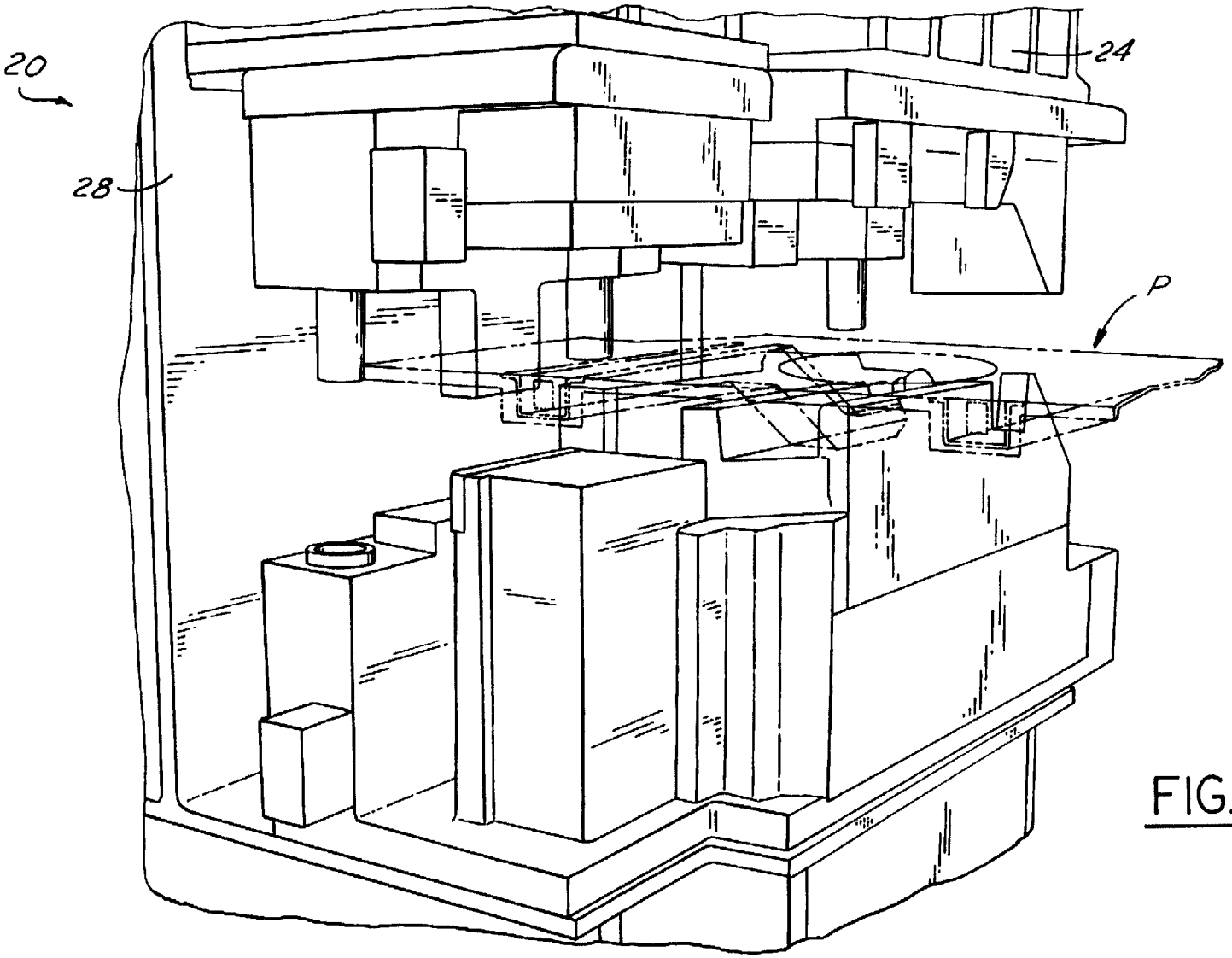
FIG. 4 is a perspective view taken in the direction of the arrow 4 in FIG. 2.

The flangers 22,24 and the flangers 26,28 are shown in their retracted positions in FIG. 1, and in their advanced or operative positions closer to the work station in FIG. 2. The flangers 22 and 26, being mounted on table 40, move as a unit between retracted and advanced positions. The flangers 24 and 28, being mounted on table 42, likewise move as a unit between advanced and retracted positions. A power drive 50 for the flangers 22,26 and a power drive 52 for the flangers 24,28 move the flangers between their retracted and advanced positions. The drives 50 and 52 may be programmed to move the flangers to different advanced positions depending on the desired cross car dimension of the panel, or adjustable stops 54 along the guides 44 and 45 engageable with bumpers 55 on the tables 40 and 42 may be provided for this purpose.

The flangers 22,24 are mirror images of one another. Each has a frame 58 provided with a bed 60 having a pad 62. The pad 62 is mounted for vertical movement on a spring unit, which in this instance is a gas spring 64. The gas spring 64 normally holds the pad in the elevated position of FIG. 7, but is yieldable to permit the pad to be depressed to the FIG. 7A position. Each flanger 22,24 also has a ram 68 above the pad 62 which is mounted on the frame 58 for vertical sliding movement between an upper or retracted position shown in FIG. 7 and a lower or advanced position shown in FIG. 7A. The ram has a platen 69 directly above the pad 62. The bed 60 has an integral, rigid flange-forming tool 70 adjacent to the pad 62. The top of the tool 70 is level with the top horizontal surface 72 of the pad when the pad is in its uppermost position shown in FIG. 7.

Figure 5:
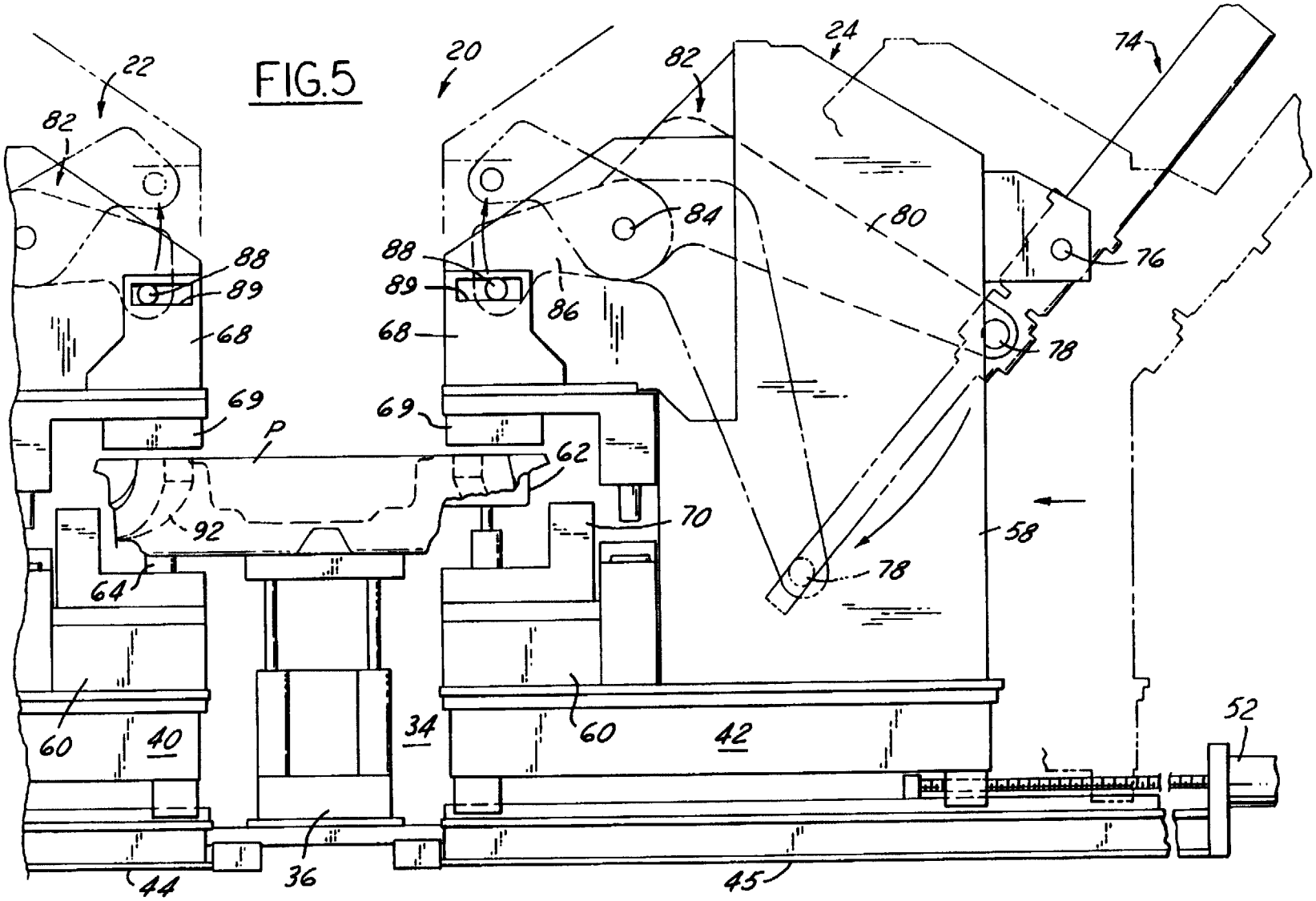
FIG. 5 is a view taken on the line 5—5 in FIG. 3.

The ram 68 is moved up and down by a power unit which preferably is in the form of a ball screw drive 74. Referring to FIG. 5, the ball screw drive is pivoted at 76 to the frame 58 and its outer end is pivoted at 78 to the end of an arm 80 of a bellcrank lever 82. The bellcrank lever 82 is pivoted to the machine frame at 84 and its other arm 86 carries a roller 88 movable along a guide 89 on the ram. When the panel P is laid on the support as in FIG. 7, each side edge portion thereof is supported on the pad 62 of one of the flangers 22,26, with the side edge of the panel extending over the flange-forming tool 70. When the ram moves down to the FIG. 7A position, the pad is depressed by the platen 69 and the side edge portion of the panel is bent up by the flange-forming tool 70 to form a flange 90.

Figure 7:
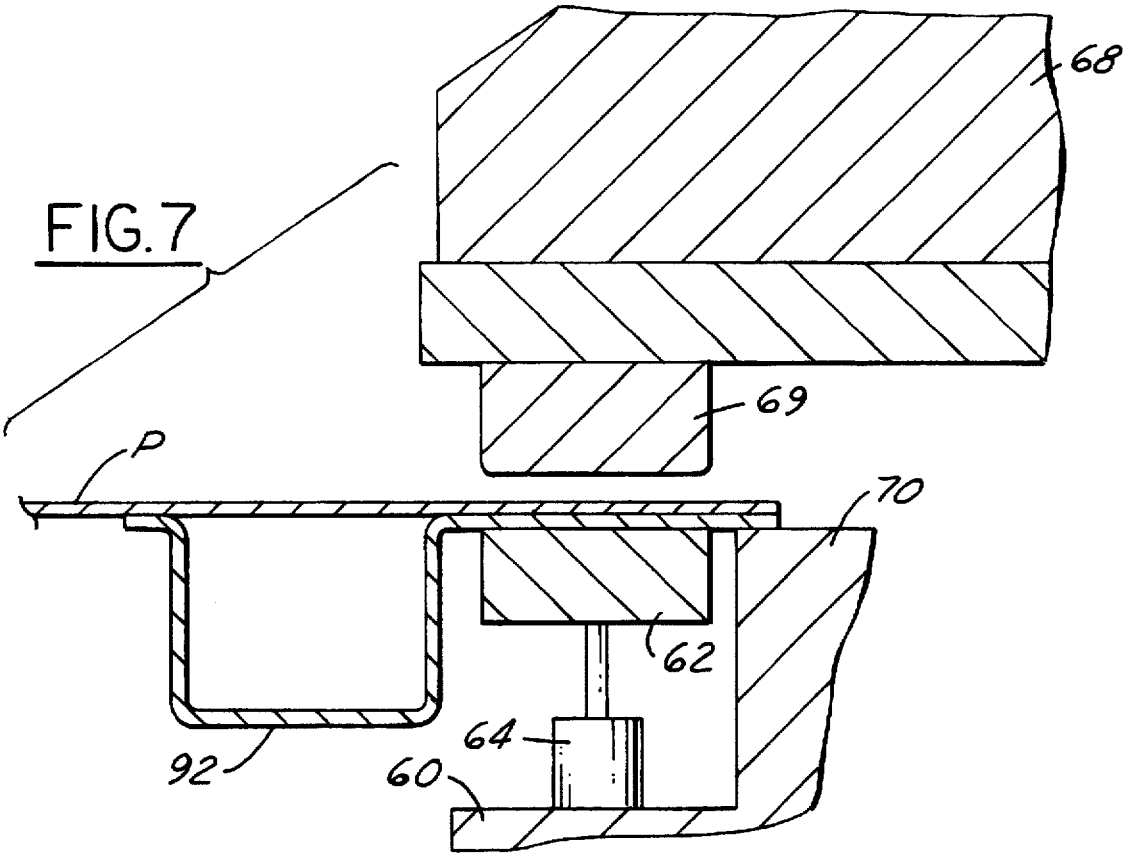
FIG. 7 is a fragmentary sectional view of one of the flangers showing the ram in raised position prior to forming a flange on one edge of the panel.
Figure 7A:
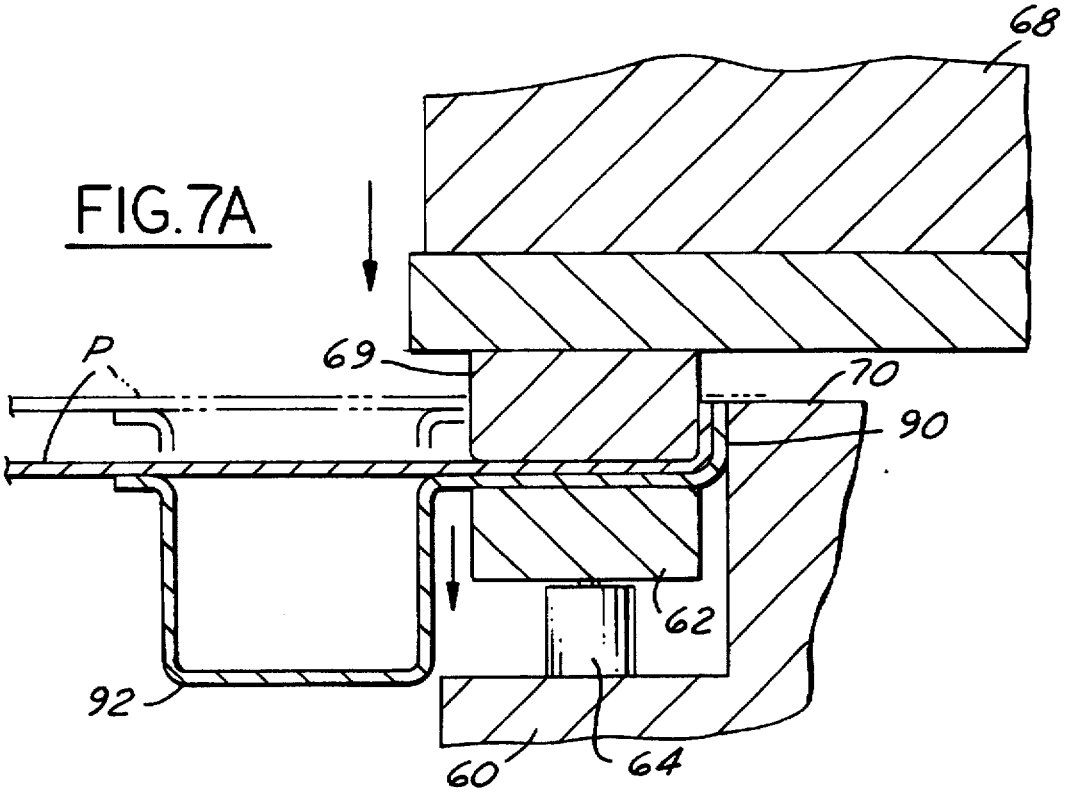
FIG. 7A is a view similar to FIG. 7 but showing the ram in its lowered position forming the flange.

The floor panel P has two channels 92 on the underside adjacent the two opposite side edges. These are generally hat-shaped with the side margins thereof coinciding with the side margins of the panel so that they are bent up with the side edges of the floor panel as shown in FIG. 7A.

The flangers 26 and 28 are mirror images of one another. Each has a frame 100 provided with a base plate or die 102. Each flanger 26,28 also has a ram 104 above the base plate 102 which is mounted on the frame 100 for vertical sliding movement between an upper or retracted position shown in FIG. 8 and a lower or advanced position shown in FIG. 8B. A pad 106 is mounted on the ram 104 above the base plate 102 for vertical movement by a spring unit, which in this instance is a gas spring 108. The gas spring 108 normally holds the pad extended in the position of FIG. 8, but is yieldable to permit the pad to be depressed to the FIG. 8B position. The ram has an integral, rigid flange-forming tool 110 adjacent to the pad 106.

Figure 6:
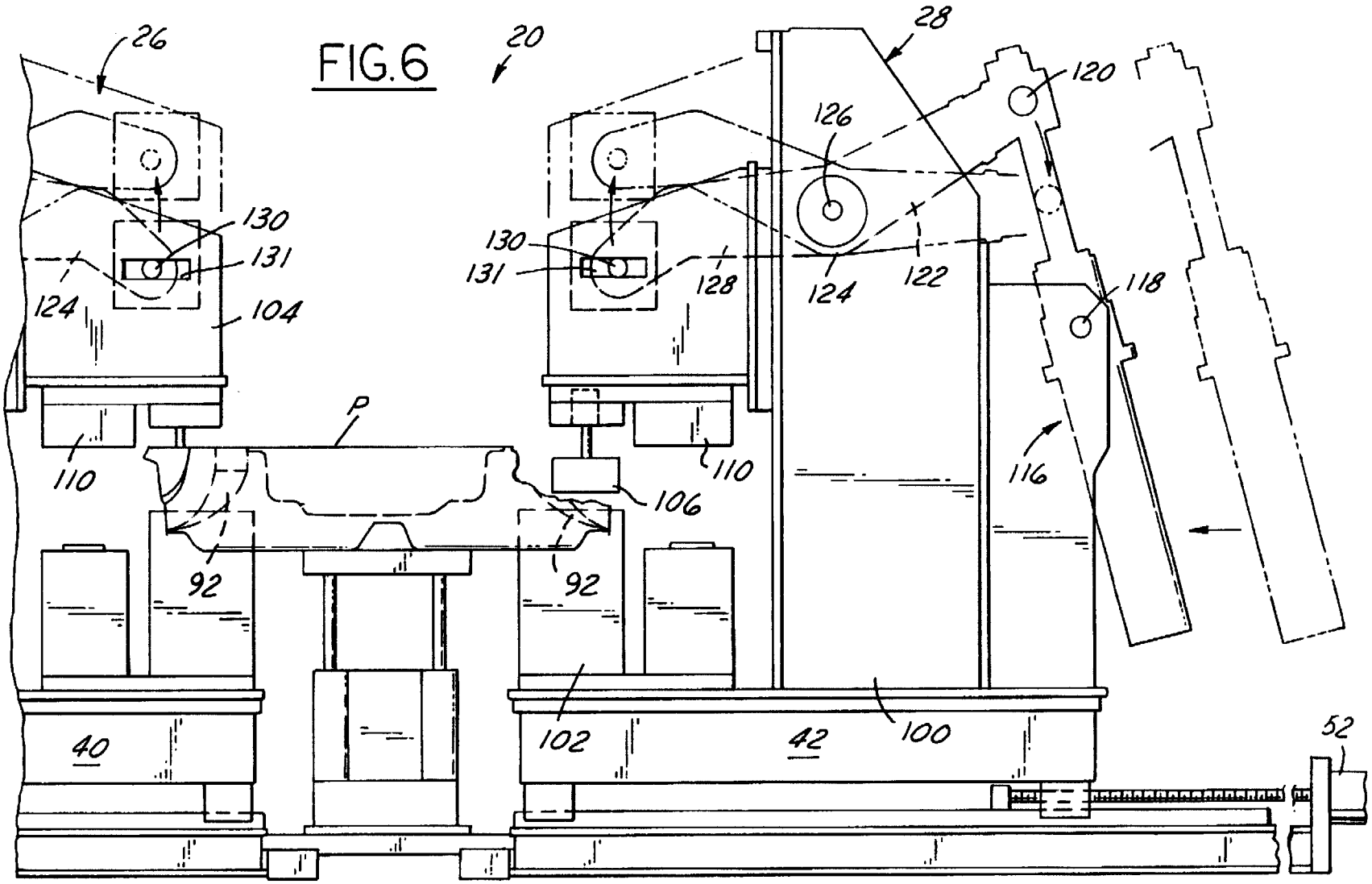
FIG. 6 is a view taken on the line 6—6 in FIG. 3.

The ram 104 is moved up and down by a power unit which preferably is in the form of a ball screw drive 116. Referring to FIG. 6, the ball screw drive is pivoted at 118 to the frame 100 and its outer end is pivoted at 120 to the end of an arm 122 of a bellcrank lever 124. The bellcrank lever 124 is pivoted to the machine frame at 126 and its other arm 128 carries a roller 130 movable along a guide 131 on the ram. When the panel P is laid on the support as in FIG. 8, each side edge portion thereof is supported on the base plate or die 102 of one of the flangers 26,28 with the side edge of the panel extending beneath the flange-forming tool 110. When the ram moves down to the FIG. 8A position, and further to the position of FIG. 8B, the pad is depressed sufficiently to allow the flange-forming tool 110 to bend the side edge portion of the panel down and form a flange 132.

Figure 9:
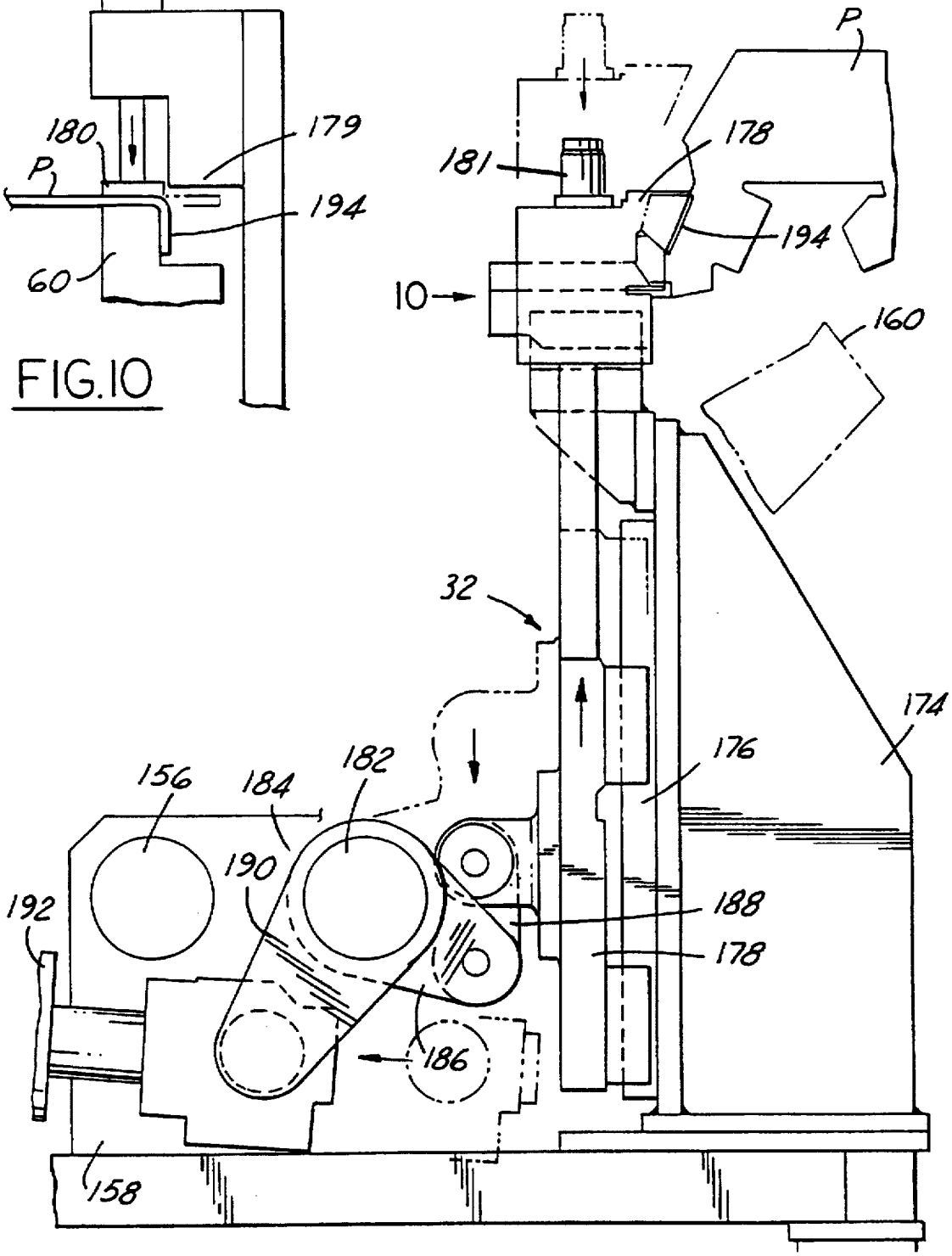
FIG. 9 is a view taken in the direction of the arrow 9 in FIG. 2, but with portions of one of the tabbers broken away.
Figures 11, 12:
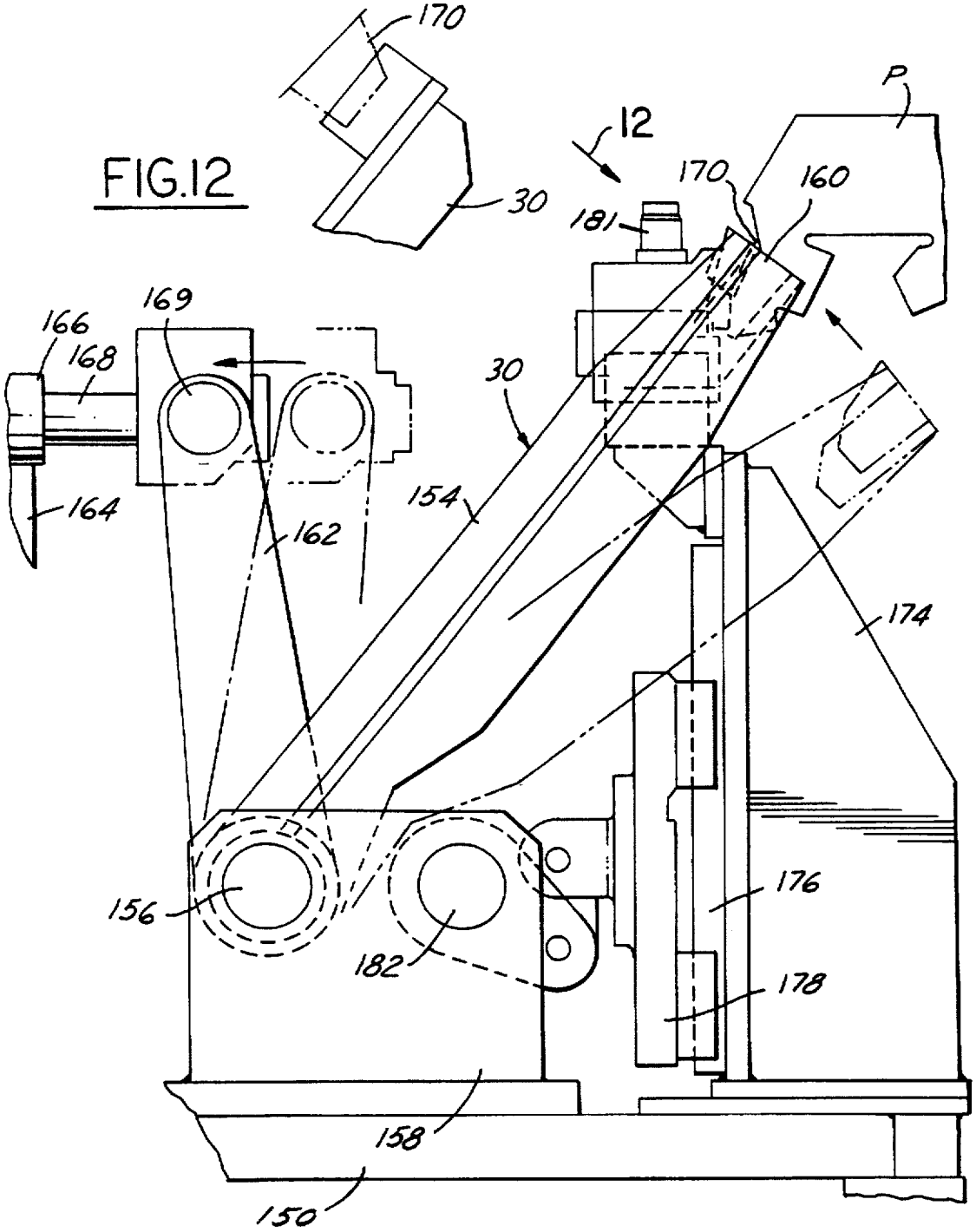
FIG. 11 is a view looking in the direction of the arrow 11 in FIG. 2.
FIG. 12 is a fragmentary view taken in the direction of the arrow 12 in FIG. 11.
Figure 13:
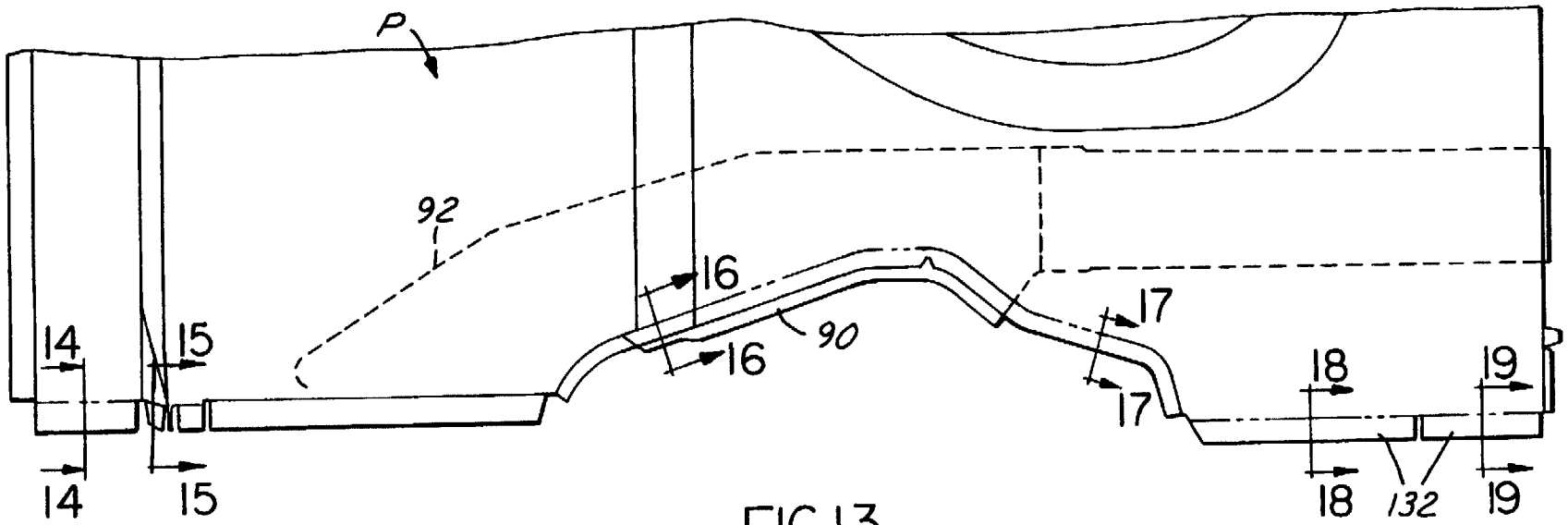
FIG. 13 is a view of a side edge portion of the panel.
Figure 19:
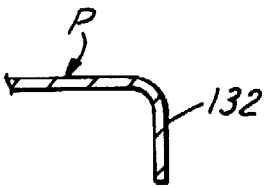
FIGS. 14, 15, 16, 17, 18 and 19 are fragmentary sectional views taken on the lines 14—14, 15—15, 16—16, 17—17, 18—18 and 19—19 on FIG. 13.
Figure 18:
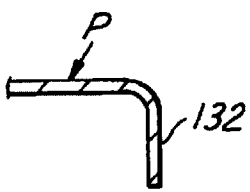
Figure 17:
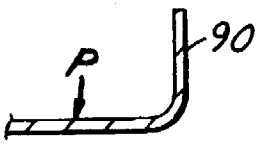
Figure 16:
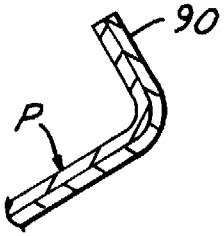
Figure 15:
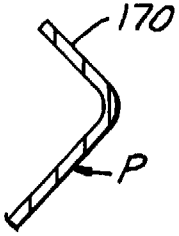
Figure 14:
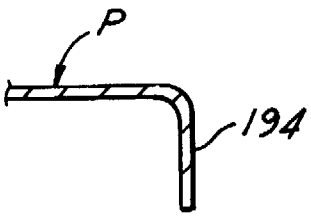

The bending units or tabbers 30 and 32 are mounted on a table 150 at the front of the apparatus. The table 150 is movable on track or guide 152 toward and away from the work station 34 by a power unit 153. The track 152 is perpendicular to tracks 44 and 45. The tabber 30 comprises a pair of arms 154 rigidly mounted on the ends of a transverse horizontal shaft 156 which is pivoted for rotation in blocks 158 (FIGS. 9 AND 11)secured to the top surface of the table 150. The arms 154 extend upwardly from the shaft 156 at a forward inclination and each has a tab-bending tool 160 at the upper end. Also rigidly mounted on the shaft 156 are crank arms 162. A stationary support 164 on the table 150 mounts a ball screw drive 166. The rod 168 extending from the drive is pivoted at 169 to the upper end of the crank arms 162 so that retraction of the rod causes the arms 154 to pivot from the broken line position in FIG. 11 to the solid line position thereof and thereby cause the tab-bending tools 160 to bend tabs 170 on the corners at the front of the panel over the beds 60 of the flangers 22 and 24.

The tabber 32 comprises laterally spaced apart, upright stands 174, each having guide rails 176 for guiding the vertical movement of a slide 178. Each slide 178 has at its upper end a tab-bending tool 179. Alongside the tool 179 is a pad 180 yieldably supported by a gas spring 181 for vertical movement. A horizontal shaft 182 is pivoted for rotation in the blocks 158 and is parallel to the shaft 156 of tabber 30. Secured to the opposite ends of the shaft 182 are bellcrank levers 184. One arm 186 of each bell crank lever is pivoted to a link 188 which in turn is pivoted to one of the slides 178. The other arm 190 of each bellcrank lever is pivoted to a ball screw drive 192 which is capable of taming the bellcrank lever as will be apparent in FIG. 9 to raise or lower the slide. When the slides 178 are lowered from their uppermost positions, the pads 180 clamp the panel against the beds 60 of the flanges 22 and 24 while the tab-bending tools 179 on the slides form tabs 194 on the corners at the front of the panel.

Figure 8:
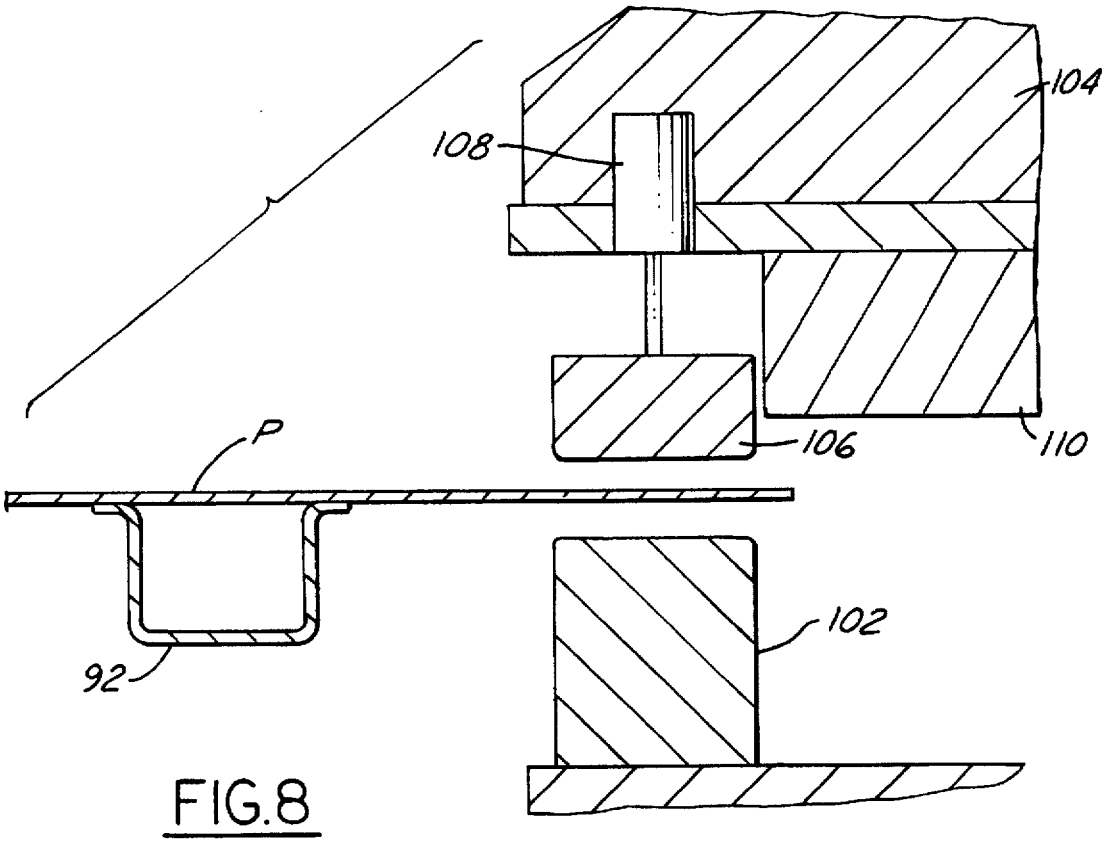
FIG. 8 is a fragmentary sectional view showing the ram of a different forming unit in its raised position.
Figure 8A:
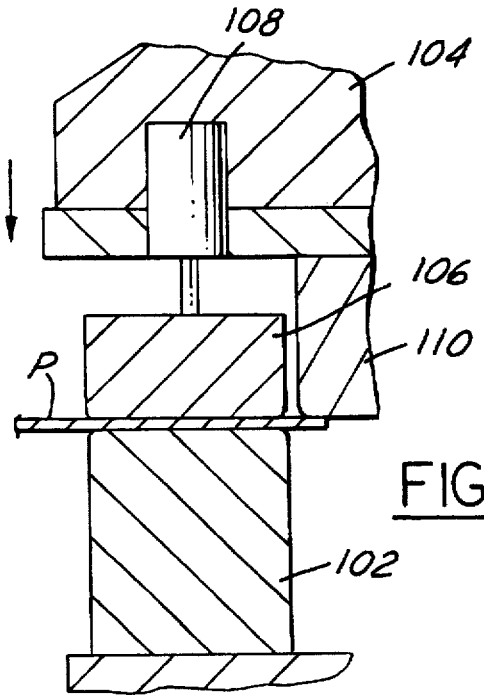
FIG. 8A is a view similar to FIG. 8 but showing the ram after it has descended partway in its downward travel into initial contact with an edge portion of the panel.
Figure 8B:
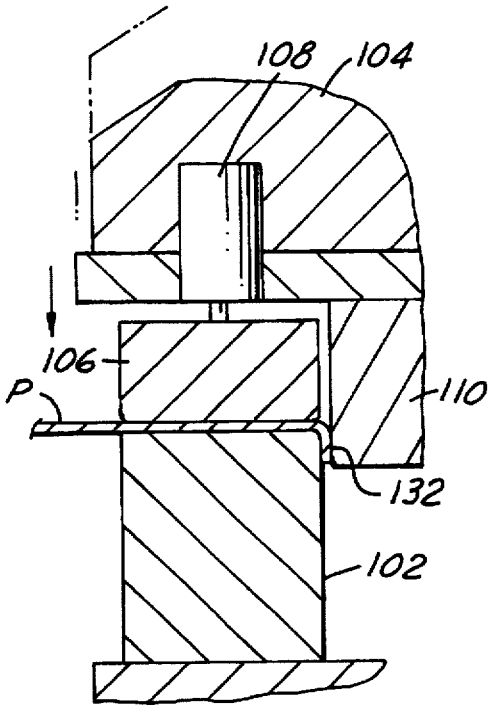
FIG. 8B is a view similar to FIGS. 8 and 8A but after the ram has completed its downward travel and has formed a flange on the edge of the panel.
Figure 10:
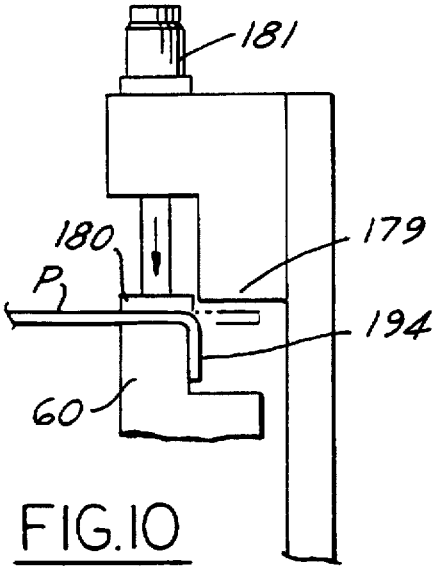
FIG. 10 is a fragmentary view taken in the direction of the arrow 10 in FIG. 9.

In operating the apparatus of this invention, a panel P is lowered onto the support 36 while the flangers are in the retracted positions of FIG. 1. The tables 40 and 42 on which the flangers 22,24 and 26,28 are mounted, are then moved to the advanced position of FIG. 2 on tracks or guides 44 by the power drives 50 and 52 to place the flangers in an operative position adjacent to the work station 34. FIG. 7 shows the relationship between the flanger 24 and an edge portion of the panel. FIG. 8 shows the relationship between the flanger 28 and the edge portion of the panel. The tabbers 30 and 32 on tables 150 are also advanced to a position adjacent to the work station by the power unit 153.

Thereafter, the ball-screw drives 74 for the flangers 22 and 24 are operated as will be apparent in FIGS. 7 and 7A to lower the rams 68 and form upwardly extending flangers 90 on opposite sides of the panel. The panel is firmly gripped by the flanges 22 and 24 so that the support 36 can be retracted by lowering it away from the panel. Thereafter, the ball-screw drives 116 for the flangers 26 and 28 are operated as will be apparent in FIG. 8—8B to lower the ram 104 and form downwardly extending flanges 132 on opposite sides of the panel, and the power units 166 and 192 for the tabbers 30 and 32 are operated to form the tabs on the corners at the front end of the panel.

The rams of the flangers 26 and 28 are raised and the tabbers 30 and 32 are withdrawn. Finally, the rams of the flangers 22 and 24 are raised to release the panel and the flangers then withdrawn to their retracted positions. The panel thus formed to the required cross car dimension by the formation of flanges thereon may then be removed from the support 36 through the space above the support and between the flangers.

What is claimed is:

1. Apparatus for forming the opposite side edge portions of a panel comprising a panel support, a first forming unit operative to form one side edge portion of the panel, a second forming unit operative to form the opposite side edge portion of the panel, a first guide supporting the first forming unit on one side of the support for movement toward and away from an advanced position adjacent the one side edge portion of the panel when supported by the support, a second guide supporting the second forming unit for movement toward and away from an advanced position adjacent the opposite side edge portion of the panel when supported on the support, power units for moving said forming units along said respective guides, and first and second power devices operative to activate the respective first and second forming units when they are in their advanced positions to form the opposite side edge portions of the panel, wherein said first forming unit is operative to form a first flange on said one side edge portion of the panel and the second forming unit is operative to form a second flange on said opposite side edge portion of the panel, and wherein each of said first and second forming units comprises a base adapted to support the panel adjacent a side edge portion thereof, a ram having a panel-clamping pad, said ram being movable in a direction toward the base to a panel-clamping position in which the pad clamps the panel against the base, said ram having a flange-forming tool, said ram being movable in the same direction beyond the panel-clamping position to a flanging position in which the flange-forming tool forms a first or second flange on one of the side edge portions of the panel, a yieldable device supporting said pad on said ram permitting said pad to yield as said ram moves beyond the panel-clamping position to the flange-forming position, and a drive for moving the ram as aforesaid.

2. Apparatus as defined in claim 1, wherein said drive for moving the ram of each of said forming units is a ball-screw drive.

3. Apparatus as defined in claim 1, and further including a bending unit for forming at least one tab on an end portion of the panel, a third guide supporting said bending unit for movement toward and away from the end portion of the panel to an advanced position adjacent to the end portion of the panel, and a power device for operating the bending unit in the advanced position thereof to form the tab.

4. Apparatus for forming the opposite side edge portions of a panel comprising a panel support, a first forming unit operative to form on one side edge portion of the panel, a second forming unit operative to form the opposite side edge portion of the panel, a first guide supporting the first forming unit on one side of the support for movement toward and away from an advanced position adjacent the one side edge portion of the panel when supported by the support, a second guide supporting the second forming unit for movement toward and away from an advanced position adjacent the opposite side edge portion of the panel when supported on the support, power units for moving said forming units along said respective guides, and first and second power devices operative to activate the respective first and second forming units when they are in their advanced positions to form the opposite side edge portions of the panel, wherein said first forming unit is operative to form a first flange on said one side edge portion of the panel and the second forming unit is operative to form a second flange on said opposite side edge portion of the panel, wherein each of said first and second forming units comprises a base having a pad adapted to support the panel adjacent a side edge portion thereof, a ram movable in a direction toward the base to a panel clamping position in which the ram clamps the panel against the pad, said base having a flange-forming tool, said ram being movable in the same direction beyond the panel-clamping position to a flanging position in which the flange-forming tool forms a first or second flange on one of the side edge portions of the panel, a yieldable device supporting said pad on said base permitting said pad to yield as said ram moves beyond the panel-clamping position to the flange-forming position, and a drive for moving the ram as aforesaid.

5. Apparatus as defined in claim 1, wherein said drive for moving the ram of each of said forming units is a ball-screw drive.

6. Apparatus for forming the opposite side edge portions of a panel comprising a panel support, a first forming unit operative to form on one side edge portion of the panel.

a second forming unit operative to form the opposite side edge portion of the panel, a first guide supporting the first forming unit on one side of the support for movement toward and away from an advanced position adjacent the one side edge portion of the panel when supported by the support, a second guide supporting the second forming unit for movement toward and away from an advanced position adjacent the opposite side edge portion of the panel when supported on the support, power units for moving said forming units along said respective guides, and first and second power devices operative to activate the respective first and second forming units when they are in their advanced positions to form the opposite side edge portions of the panel, wherein said first forming unit is operative to form a first flange on said one side edge portion of the panel and the second forming unit is operative to form a second flange on said opposite side edge portion of the panel, further including a third forming unit operative to form a third flange on said one side edge portion of the panel, a fourth forming unit operative to form a fourth flange on the opposite side edge portion of the panel, the third forming unit being supported on said one side of the support alongside said first forming unit for movement as a unit therewith toward and away from an advanced position adjacent the one side edge portion of the panel when supported on said support, the fourth forming unit being supported on the opposite side of the support alongside said second forming unit for movement as a unit therewith toward and away from an advanced position adjacent the opposite side edge portion of the panel when supported on said support, and third and fourth power devices operative to operate the respective third and fourth forming units when in their advanced positions to form the third and fourth flanges on the opposite side edge portions of the panel.

7. Apparatus as defined in claim 6, wherein each of said first and second forming units comprises a base adapted to support the panel adjacent a side edge portion thereof, a ram having a panel-clamping pad, said ram being movable in a direction toward the base to a panel-clamping position in which the pad clamps the panel against the base, said ram having a flange-forming tool, said ram being movable in the same direction beyond the panel-clamping position to a ranging position in which the flange-forming tool forms a first or second flange on one of the side edge portions of the panel, a yieldable device supporting said pad on said ram permitting said pad to yield as said ram moves beyond the panel-clamping position to the flange-forming position, a drive for moving the ram as aforesaid, and wherein each of said third and fourth forming units comprises a bed having a second pad adapted to support the panel adjacent one of the side edge portions thereof, a second ram, said second ram being movable in a direction toward the second pad to a panel-clamping position in which the second ram clamps the panel against the second pad, said bed having a second flange-forming tool, said second ram being movable in the same direction beyond the panel-clamping position thereof to a flanging position in which the second flange-forming tool forms a third or fourth flange on one of the side edge portion of the panel, a second yieldable device for supporting said second pad on said bed permitting said second pad to yield as the second ram moves beyond the panel-clamping position to the flange-forming position, and a second drive for moving said second ram as aforesaid.

8. Apparatus as defined in claim 7, wherein said first and second guides are parallel.

9. Apparatus as defined in claim 8, and further including a bending unit for forming at least one tab on an end portion of the panel, a third guide supporting said bending unit for movement toward and away from the end portion of the panel to an advanced position adjacent to the end portion of the panel, and a power device for operating the bending unit in the advanced position thereof to form the tab.

10. Apparatus as defined in claim 9, wherein said third guide is perpendicular to the paths of the first and second forming units.

11. Apparatus as defined in claim 10, wherein the drive for moving the ram of each of said forming units is a ball-screw drive, and the power device for the bending unit is a ball screw drive.

* * * * *

UNITED STATES PATENT AND TRADEMARK OFFICE

CERTIFICATE OF CORRECTION

PATENT NO. : 5,735,161

DATED : April 7, 1998

INVENTOR(S) : Gerald A. Brown/Gerrit W. Sloat/Timothy A. VerVaecke

It is certified that error appears in the above-indentified patent and that said Letters Patent is hereby corrected as shown below:

Column 6, line 39, change dependency of "claim 1" to "claim 4".

Column 7, line 30, change "ranging" to "flanging".

Signed and Sealed this

Fourteenth Day of July, 1998

Bruce Lehman

*Attest:*

BRUCE LEHMAN

*Attesting Officer*

*Commissioner of Patents and Trademarks*